United States Patent [19]

Emson et al.

[11] 3,974,026

[45] Aug. 10, 1976

[54] BELT PRESS WITH ROTATABLE CYLINDER AND ADJUSTABLE PRESSURE MEMBER

[75] Inventors: Stephen Derek Emson; Christopher Stephen Norton; James Royston Wilson, all of Sheffield, England

[73] Assignee: Escher Wyss G.m.b.H., Ravensburg, Germany

[22] Filed: Feb. 28, 1974

[21] Appl. No.: 446,969

[30] Foreign Application Priority Data

Mar. 1, 1973 Switzerland ..... 2995/73

[52] U.S. Cl. ..... 162/358; 34/123; 100/121; 100/153; 100/154; 162/369

[51] Int. Cl.[2] ..... D21F 3/06

[58] Field of Search ..... 162/358, 359, 360 R, 162/205, 207, 297, 305, 369, 206; 100/90, 153, 154, 93 RP, 118, 121, 156, 211; 34/122, 123, 124, 111, 155

[56] References Cited

UNITED STATES PATENTS

| | | | |
|---|---|---|---|
| 2,135,763 | 11/1938 | Nicholson | 100/154 X |
| 2,714,839 | 8/1955 | Mazer | 162/297 |
| 2,919,495 | 1/1960 | Underhay et al. | 162/359 |
| 3,293,121 | 12/1966 | Martin | 162/358 |
| 3,471,363 | 10/1969 | Schmidt | 162/205 X |
| 3,598,346 | 8/1971 | Buchanan | 34/111 X |
| 3,748,225 | 7/1973 | Busker et al. | 162/358 X |
| 3,771,236 | 11/1973 | Candor et al. | 34/155 X |
| 3,783,097 | 1/1974 | Justus | 162/358 |
| 3,853,698 | 12/1974 | Mohr | 162/358 |

*Primary Examiner*—S. Leon Bashore
*Assistant Examiner*—Richard V. Fisher
*Attorney, Agent, or Firm*—Kenyon & Kenyon Reilly Carr & Chapin

[57] ABSTRACT

The belt press is constructed with a rotatable cylinder, a guide belt to confine the material between the belt and cylinder, and a press member for pressing the belt towards the cylinder to remove water from the confined material. The press member has a curved face slightly spaced from the belt as well as a pressure chamber which delivers a pressurized medium, such as water or air, against the belt over the face of the press member.

4 Claims, 4 Drawing Figures

BELT PRESS WITH ROTATABLE CYLINDER AND ADJUSTABLE PRESSURE MEMBER

This invention relates to a belt press, and particularly, to a belt press employing a cylinder and an overlying guide belt.

Heretofore, belt presses have been constructed with a cylinder and a guide belt which is guided along a portion of the cylinder periphery; the material to be pressed being introduced between the guide belt and the cylinder. Generally, there is difficulty in forming a fairly high contact pressure to boost the removal of water from the material, for example, a fibrous material, being pressed. In some cases, these belt presses use contact pressure rollers which are operative only along a line. As a result, such rollers are not very effective.

Accordingly, it is an object of the invention to provide a belt press which uses a simple means for effectively pressing materials.

It is another object of the invention to provide a belt press with an effective press means which can be easily operated.

Briefly, the invention provides a belt press comprising a rotatable cylinder and a guide belt for confining material to be pressed between the cylinder and belt with a means for pressing the guide belt against the cylinder over an expanded area. The means includes a pressure member having at least one chamber for connection to a pressure medium source. The pressure member is disposed adjacent the guide belt and includes an arcuate portion corresponding to the shape of the cylinder disposed in spaced opposition to the peripheral portion of the cylinder to define a gap and at least one aperture in the arcuate portion to communicate with the chamber.

As a result of the pressure of the pressure medium operative in the chamber, the pressure member enables the guide belt to be pressed uniformly towards the cylinder so that water can be removed from the web of material and the material dried at the same time. The pressure medium used can be a gas such as, for instance, air, or a liquid, such as, for instance, water. If the guide belt is permeable to air and is, for instance, a felt or fabric, an advantageous air flow can be formed from the pressure chamber into the cylinder, in which, as a rule, there is a negative pressure. If the pressure medium to be used is water, the guide belt can either be impermeable to water, or an impermeable pressure belt can be disposed between the guide belt and the pressure member. Alternatively, use can be made of a cylinder with a solid impermeable surface. In that case, care must be taken that the liquid, for instance, water, pressed out of the material, can be removed. For instance, the water pressed out can be absorbed in the guide belt if made of felt. Alternatively, the guide belt can be formed with apertures or, for instance, grooves for the removal of the liquid.

Preferably, the cylindrical peripheral surface of the cylinder can be permeable, and the cylinder can have a means for removing the liquid emerging from the material. This means can take the form of, for instance, a suction box of known construction. Alternatively, a discharge tube can be disposed at the lowest place inside the cylinder and can be connected to a suction or removal means.

According to another embodiment of the invention, the pressure member has an adjusting means for adjusting the distance of the pressure member from the cylinder and the guide belt. As a result, the distance of the pressure member from the cylinder and the guide belt can be adapted to the thickness of the layer of material to be pressed. This results in a reduction of pressure medium consumption.

The adjusting means can include a contact pressure device actuable by a pressure medium for pressing the pressure member against the guide belt with a constant force, so that changes in the thickness of the layer of material to be dried are automatically compensated.

The pressure contact device can include a bellows to urge the pressure member towards the guide belt or, in another embodiment, a cylinder and piston arrangement to carry out the same function.

The pressure member can have at least two chambers disposed sequentially one after the other, as viewed in the peripheral direction of the cylinder. This boosts the stability of the pressure member peripherily of the cylinder, ensuring that the gap between the pressure member and guide belt at the periphery of the pressure member is always the same or follows a required course. In one embodiment, the chamber or chambers of the pressure member and a contact pressure device are connected one after the other in relation to the pressure medium flow. In this case, a constriction is disposed between the chamber and the contact pressure device to throttle the flow. In addition, the cross-section of the chamber effective in forming the pressure force is made larger than the effective cross-section of the contact pressure device. The result is a simple embodiment in which the size of the gap between the pressure member and the guide belt can be automatically adjusted.

As already mentioned, particularly when the pressure medium used is water and the guide belt is permeable to water, a special pressure belt can be disposed between the pressure member and guide belt. This pressure belt is movable together with the guide belt and is made to be impermeable to water and the pressure medium in general. The pressure belt can also be used if the pressure medium is a gas such as, for instance, air.

These and other objects and advantages of the invention will become more apparent from the following detailed description and appended claims taken in conjunction with the accompanying drawings in which:

Figure 1:
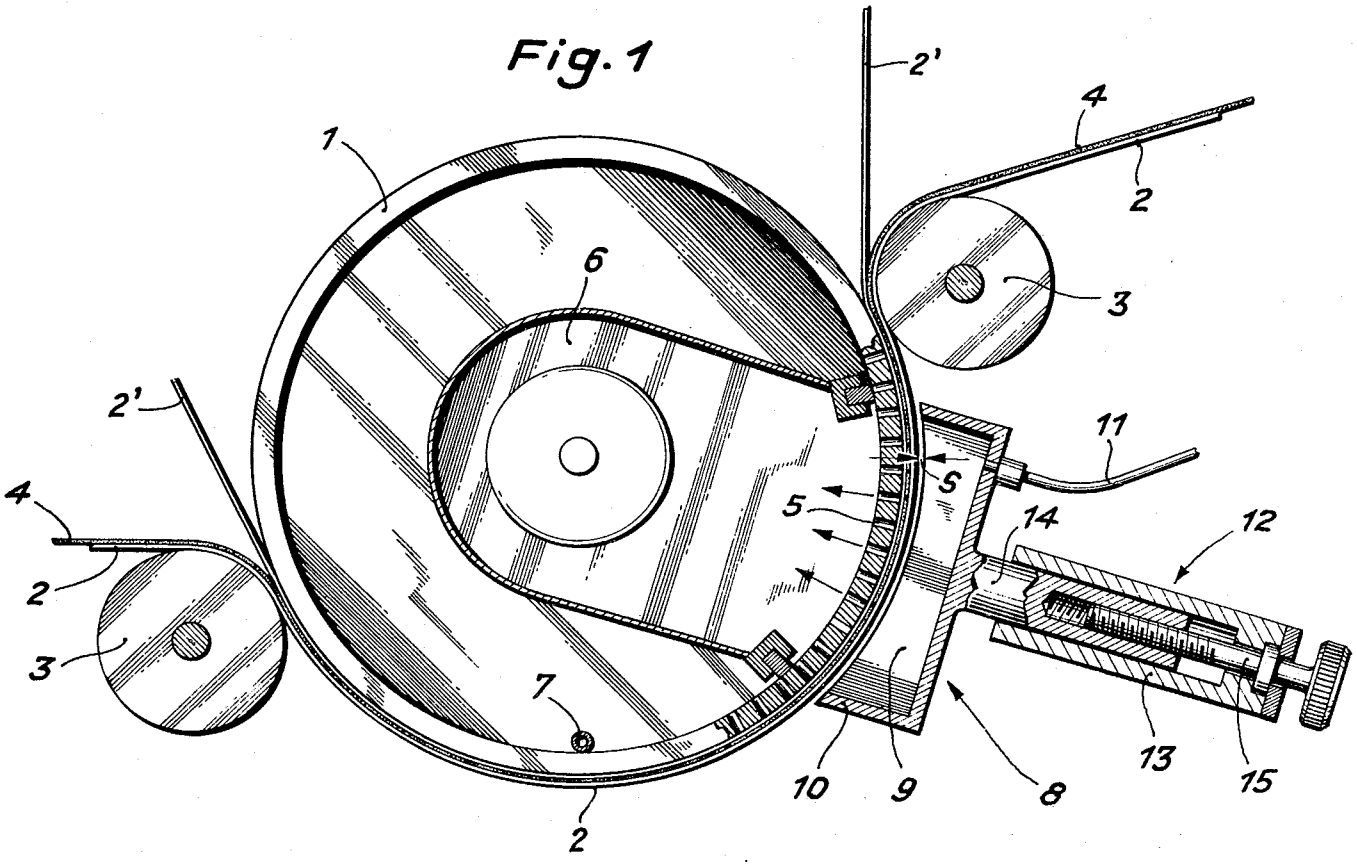
FIG. 1 illustrates a sectional view through the cylinder of a belt press of the invention with a simple embodiment of the pressure member.

Referring to FIG. 1, a belt press comprises a rotatable cylinder 1 and a guide belt 2 guided by means of guide rollers along a peripheral portion of the cylinder 1. The guide belt 2 can be permeable to water, such as, for instance, a felt or a fabric, or impermeable, such as, for instance, a rubberized fabric. The material 4 to be dried is disposed in the form of a thin layer between the guide belt 2 and the cylinder 1 and is in the nature of, for instance, paper or some other fibrous or granular material.

The generated surface of the cylinder 1 is formed with apertures 5 and can also have a shrunk-on round sieve as is known. The result is a permeable cylindrical surface of the cylinder 1. The cylinder 1 contains a suction box 6 which is constructed in known manner and connected to a vacuum source (not shown). The inside of the cylinder 1 also contains a means, such as a suction or removal pipe 7 formed with apertures (not shown), and connected to a pump or vacuum pump for sucking in or otherwise removing liquid deposited within the cylinder 1.

In order to press the guide belt 2 against the cylinder 1 and therefore remove the water from the material 4, a press means is provided exteriorly of the cylinder 1 and belt 2 across an expanded area of the belt 2. This press means includes a pressure member 8 which contains a chamber 9 whose peripheral wall 10 has an arcuate portion which is adapted to the shape of the belt 2 and the cylinder 1 and is connected via a pressure line 11 to a pressure medium source (not shown). As shown, the arcuate portion of the pressure member 8 is disposed adjacent to the guide belt 2 to define a gap S. In addition, the arcuate portion contains at least one aperture to communicate the gap S with the pressure chamber 9. As shown, the arcuate portion is open so as to define a single large opening.

In order to adjust the distance of the chamber 9 from the guide belt 2 and the cylinder 1, an adjusting means 12 is provided. This adjusting means 12 contains a stationary guide 13 in which a pin 14 of the pressure member 8 is guided. Engaging with the pin 14 is an adjusting screw 15 rotatably retained in the guide 13.

The pressure member 8 can be so adjusted by the adjusting means 12 in relation to the cylinder 1 and the guide belt 2 that the gap S is formed between the wall 10 of the chamber and the guide belt 2 the gap remaining uniform throughout. When a pressure medium, for instance, compressed air, is fed through the pressure line 11, the pressure of the pressure medium forces the guide belt 2 against the cylinder 1, so that liquid is pressed out of the material 4. The liquid pressed out of the material 4 then passes through the apertures 5 into the cylinder 1 and is removed therefrom through the suction box 6 and the pipe 7. The pressure medium escaping through the gap S represents a loss, so that the gap S is adjusted as small as possible. On the other hand, wear on the guide belt 2 and pressure member 8 is avoided by preventing contact between the wall 10 and the guide belt 2.

The pressure medium fed through the pressure line 11 can be a gas, for instance, air. For instance, an advantageous flow of hot dry air can be formed through a permeable guide belt 2 and the layer of the material 4 into the inside of the cylinder 1. If on the other hand the intention is merely to obtain a contact pressure effect with as low an air consumption as possible, use can be made of an impermeable guide belt. A special pressure belt made of an impermeable material can also be provided between the pressure member 8 and the guide belt 2, as described hereinafter in relation to FIGS. 2 and 3. This is more particularly the case if the pressure medium used is a liquid, for instance, water.

Figure 2:
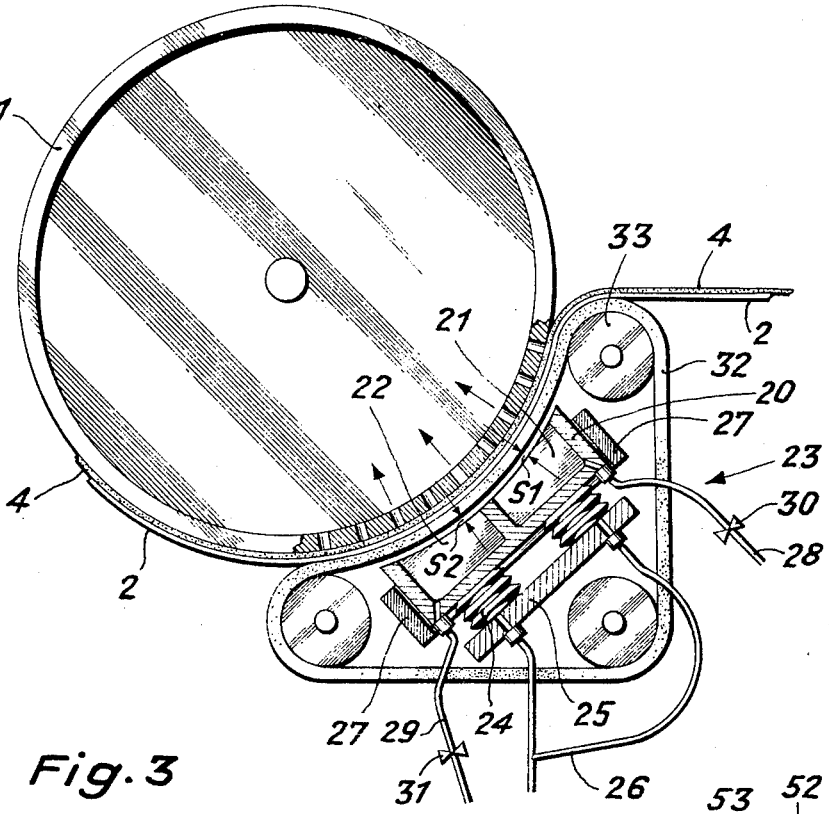
FIG. 2 illustrates a sectional view corresponding to FIG. 1 through an embodiment of the belt press of the invention having a contact pressure device actuable by a pressure medium.

Referring to FIG. 2, wherein like reference characters indicate like parts as above, a pressure member 20 has two chambers 21, 22 which are sequentially arranged relative to the periphery of the cylinder 1. The pressure member 20 also has a contact pressure device 23 containing two bellows 24 which bear against a stationary plate 25. The two bellows 24 are connected via a connecting line 26 to a pressure medium source (not shown). The pressure member 20 is guided radially of the cylinder 1 by fixed guides 27. The chambers 21, 22 are connected via throttling means in the form of lines 28, 29 with throttle members 30, 31 to a means for supplying a pressure medium (not shown). Disposed between the cylinder 1 and the guide belt 2 and the pressure member 20 is a pressure belt 32 which is guided over guide rollers 33. Preferably, the pressure belt 32 is made of a material impermeable to water such as, for instance, a rubber-like fabric, and allows water to be used as the pressure medium in the bellows 24 and chambers 21, 22 of the pressure member 20.

When in operation, pressure medium is fed to the bellows 24 through the pressure line 26. A force is then evolved in the bellows 24 which forces the pressure member 20 against the pressure belt 32, the guide belt 2 and the cylinder 1. At the same time, a pressure medium is fed to the chambers 21, 22 through the lines 28, 29. The pressure medium can be the same as the medium fed to the bellows 24, or alternatively can be different. The throttling members 30, 31 can so adjust the pressure of the medium fed to the chambers 21, 22 that gaps S1, S2, which can be identical or different, are left between the peripheral walls of the chambers 21, 22 and the pressure belt 32.

The sub-division of the pressure member 20 into two chambers 21, 22 disposed one after the other, as viewed peripherally of the cylinder, has the advantage that the pressure member 20 has an increased lateral stability. That is as one of the chambers 21, 22 approaches the belt 32 more closely than the other one, the pressure in that particular chamber immediately rises and returns the pressure member 20 to the starting position. With only one chamber, the pressure member 20 might be twisted around an axis parallel with the axis of the cylinder 1, so that one of the longitudinally extending edges would contact the belt 32, while the other edge would move all that further from the belt 32.

Figure 3:
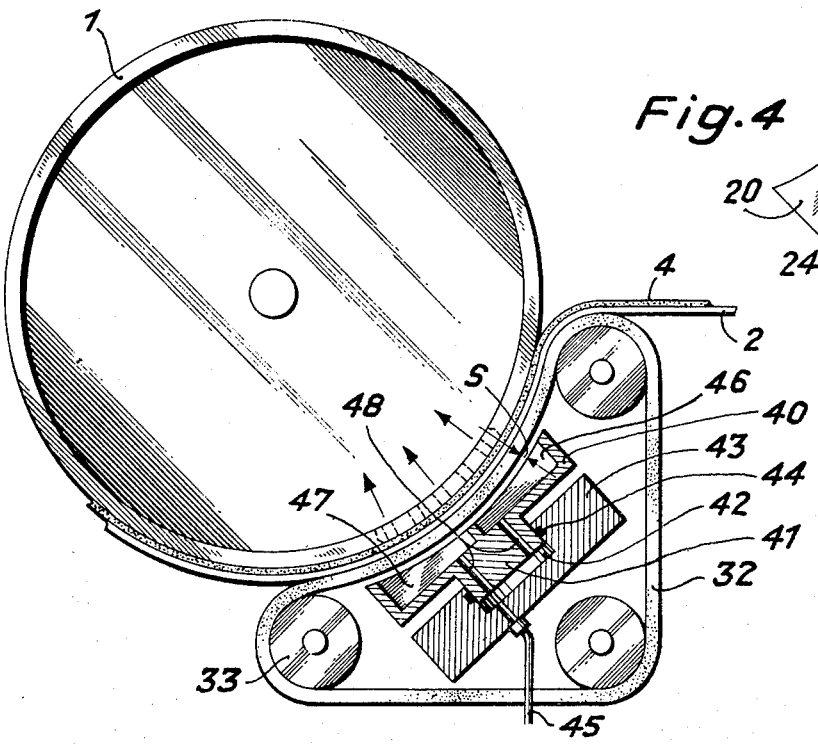
FIG. 3 illustrates a sectional view through a further embodiment similar to that illustrated in FIG. 2.

Referring to FIG. 3, wherein like elements have like reference characters as in FIG. 2, the press differs from that illustrated in FIG. 2 by a pressure member 40 having at least one piston-like projection 41. The projection is guided in a recess 42 in a supporting plate 43, a seal 44 being disposed between the projection 41 and the wall of the recess 42. The supporting plate 43 extends substantially along the whole length of the cylinder 1 and can either be formed with a number of cylindrical bores in which round pins of the pressure member 40 engage, or at least one elongate groove in which an elongate projection 41 is guided.

Disposed between the projection 41 and the end of the recess 42 is a cylindrical space connected via a pressure line 45 to a pressure medium source. The pressure member 40 has two chambers 46, 47 connected via a throttling means in the form of throttle bores or constrictions 48 to the cylinder space of the recess 42. In effect, a pressure contact device is formed by the recessed plate 43, which acts as a cylinder, and the projection 41, which acts as a piston and is slidably mounted in the recess 42 in seal-tight relationship.

In operation, the pressure member 40 is pressed by the pressure medium acting on the projection 41 against the pressure belt 32 and at the same time forces the guide belt 2 with the material 4 against the wall of the cylinder 1. At the same time, the pressure medium flows out of the recess 42 through the throttle bores 48 into the chambers 46, 47. From the chambers 46, 47, the medium flows outwards, a gap S being left between the pressure member 40 and the pressure belt 32. As a result, there is produced in the chambers 46, 47 a pressure whose force counteracts the pressure force of the medium acting on the projection 41. The effective cross-section of the chambers 46, 47 is made larger than the effective cross-section of the projection 41, while the bores or constrictions 48 affect a lower pressure in the chambers 46, 47 than the pressure operative in the recess 42. The size of the gap S depends on the cross-section of the throttle bores 48. These can therefore be adjustable. In this case also, an adjustment is possible in which the gap S is equal over the whole periphery of the pressure member 40. With different cross-sections of the throttle bores 48, unequal gaps are produced in the zone of the two chambers, 46, 47 and in some cases this may be advantageous.

Figure 4:
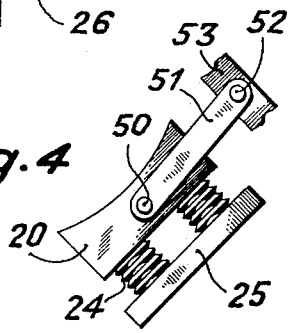
FIG. 4 illustrates a detail of a further embodiment of the contact pressure device illustrated in FIG. 2.

Referring to FIG. 4, which is a detail of FIG. 2, with a different embodiment of the guide of the pressure member 20, the pressure member 20, which bears via the bellows 24 against the plate 25, has a pin 50 with which a rod 51 rotatably engages. The other end of the rod 51 is rotatably mounted on a pin 52 attached to a fixed machine part 53. If the same arrangement with the rod 51 is also provided at the other end of the pressure member 20, such would take the place of the parallel guide 27 in FIG. 2. The rods 51 permit a substantially radial movement of the pressure member 20 in relation to the cylinder 1 while at the same time preventing any movement in the tangential direction which would result in damage to the bellows 24. The stability of the pressure member 20 in relation to the pivoting axis of the pin 50 is ensured by the aforedescribed arrangement of the two chambers 21, 22.

Clearly, the embodiments illustrated in the drawings are merely examples which can be modified in various ways. For instance, the special feed lines 28, 29 shown in FIG. 2 can be used for the chambers 46, 47 shown in FIG. 3. Conversely, the throttle bores 48 in the embodiment illustrated in FIG. 3 can be used, each of them connecting one of the chambers 21, 22 to a pair of bellows 24.

Similarly, the pressure belt 32 can be used in the embodiment illustrated in FIG. 1. In certain circumstances, the pressure belt 32 may be omitted from the embodiments illustrated in FIGS. 2 and 3.

The free opening of the chambers 9, 21, 22, 46, 47 illustrated in FIGS. 1 to 3, which is adjacent the cylinder 1, can have a perforate wall without affecting the operation of the pressure member. This construction can advantageously be used where there is a risk in operation that the pressure member might be pressed too heavily against the belts 2, 32. A perforated member would ensure that, even in such a case, the belt can move undisturbed along the pressure member.

Although the drawings show only two chambers disposed one behind the other in the peripheral direction, several chambers can, of course, also be so disposed. A number of chambers can also be disposed one beside the other in the axial direction of the roller.

Instead of a single guide belt 2, use can be made of two guide belts with the material 4 being introduced between the guide belts. FIG. 1 illustrates an embodiment of this kind containing an extra guide belt 2' which, like the guide belt 2, can be permeable or impermeable.

We claim:

1. A belt press comprising a rotatable cylinder, a guide belt guided over a peripheral portion of said cylinder to confine material to be pressed therebetween, a pressure member having at least one chamber for connection to a means for supplying a pressure medium, said chamber being disposed adjacent said guide belt, said pressure member further having an arcuate portion corresponding to the shape of said cylinder and disposed in opposition to said peripheral portion of said cylinder, said means defining at least one aperture in said arcuate portion to communicate with said chamber, and an adjusting means for adjusting the distance of said pressure member from said belt, said adjusting means including a stationary guide, a pin mounted on said pressure member and guided in said guide, and an adjusting screw engaging said pin and rotatably mounted in said guide.

2. A belt press as set forth in claim 1 wherein said peripheral portion of said cylinder is permeable and which further comprises means within said cylinder for removing liquid emerging from a liquid-containing material pressed between said belt and cylinder.

3. A belt press as set forth in claim 1 which further comprises a movable water-impermeable pressure belt between said guide belt and said pressure member.

4. A belt press as set forth in claim 3 wherein said impermeable belt is endless and which further comprises guide rollers for guiding said endless belt about said pressure member.

* * * * *